US012628964B2

(12) United States Patent
Sullivan et al.

(10) Patent No.: US 12,628,964 B2
(45) Date of Patent: May 19, 2026

(54) FLAME RESISTANT MATTRESS COVER

(71) Applicant: Sleep Number Corporation, Minneapolis, MN (US)

(72) Inventors: Kyle Sullivan, Minneapolis, MN (US); Chris Jones, Lexington, SC (US); Hummy Truh, Oak Grove, MN (US); Eric Rose, Piedmont, SC (US)

(73) Assignee: Sleep Number Corporation, Minneapolis, MN (US)

( * ) Notice: Subject to any disclaimer, the term of this patent is extended or adjusted under 35 U.S.C. 154(b) by 62 days.

(21) Appl. No.: 18/613,830

(22) Filed: Mar. 22, 2024

(65) Prior Publication Data

US 2024/0341497 A1 Oct. 17, 2024

Related U.S. Application Data

(60) Provisional application No. 63/458,653, filed on Apr. 11, 2023.

(51) Int. Cl.

| | |
|---|---|
| ***A47C 31/00*** | (2006.01) |
| ***A47C 27/00*** | (2006.01) |
| *A47C 27/08* | (2006.01) |

(52) U.S. Cl.

CPC ..... *A47C 31/001* (2013.01); *A47C 27/002* (2013.01); *A47C 27/081* (2013.01)

(58) Field of Classification Search

CPC ..... A47C 27/002; A47C 31/001
USPC ..... 5/483
See application file for complete search history.

(56) References Cited

U.S. PATENT DOCUMENTS

| | | | |
|---|---|---|---|
| 4,644,597 | A | 2/1987 | Walker |
| 4,766,628 | A | 8/1988 | Walker |
| 4,788,729 | A | 12/1988 | Walker |
| D300,194 | S | 3/1989 | Walker |
| 4,829,616 | A | 5/1989 | Walker |
| 4,890,344 | A | 1/1990 | Walker |
| 4,897,890 | A | 2/1990 | Walker |
| 4,908,895 | A | 3/1990 | Walker |
| 4,955,095 | A | 9/1990 | Gerrick |
| D313,973 | S | 1/1991 | Walker |
| 4,991,244 | A | 2/1991 | Walker |

(Continued)

FOREIGN PATENT DOCUMENTS

| | | |
|---|---|---|
| EP | 0070701 | 9/1986 |
| EP | 0600459 | 6/1994 |

(Continued)

OTHER PUBLICATIONS

English translation of European Patent Application EP 0600459 A1 (Year: 1994).*

(Continued)

*Primary Examiner* — Jason D Shanske
(74) *Attorney, Agent, or Firm* — Norton Rose Fulbright US LLP

(57) ABSTRACT

A mattress includes a mattress cover. The mattress cover has a first textile, a second textile, a zipper, and a fire-resistant textile wrap. The zipper connects the first textile to the second textile. The fire-resistant textile wrap covers at least a portion of the zipper. A portion of the first textile and the zipper define a seam. The seam is inwardly separated from an outer side surface of the mattress cover by the portion of the first textile.

20 Claims, 6 Drawing Sheets

(56) References Cited

U.S. PATENT DOCUMENTS 5,090,074 A * 2/1992 Scales ..... A47C 27/006 5/724
5,144,706 A 9/1992 Walker
5,170,522 A 12/1992 Walker
D368,475 S 4/1996 Scott
5,509,154 A 4/1996 Shafer et al.
5,564,140 A 10/1996 Shoenhair et al.
5,578,368 A 11/1996 Forsten et al.
5,642,546 A 7/1997 Shoenhair
5,652,484 A 7/1997 Shafer et al.
5,765,246 A 6/1998 Shoenhair
5,903,941 A 5/1999 Shafer et al.
5,904,172 A 5/1999 Gifft et al.
6,037,723 A 3/2000 Shafer et al.
6,108,844 A 8/2000 Kraft et al.
6,161,231 A 12/2000 Kraft et al.
6,202,239 B1 3/2001 Ward et al.
6,397,419 B1 6/2002 Mechache
6,483,264 B1 11/2002 Shafer et al.
6,686,711 B2 2/2004 Rose et al.
6,708,357 B2 3/2004 Gaboury et al.
6,763,541 B2 7/2004 Mahoney et al.
6,804,848 B1 10/2004 Rose
6,832,397 B2 12/2004 Gaboury et al.
D502,929 S 3/2005 Copeland et al.
6,883,191 B2 4/2005 Gaboury et al.
7,062,808 B1 6/2006 Brogden
7,389,554 B1 6/2008 Rose
7,484,256 B2 2/2009 Murphy et al.
7,832,038 B2 11/2010 Murphy et al.
7,865,988 B2 1/2011 Koughan et al.
8,336,369 B2 12/2012 Mahoney
8,359,688 B2 1/2013 Murphy et al.
D691,118 S 10/2013 Ingham et al.
D697,874 S 1/2014 Stusynski et al.
D698,338 S 1/2014 Ingham et al.
D701,536 S 3/2014 Shakal et al.
8,745,795 B2 6/2014 Klancnik
8,769,747 B2 7/2014 Mahoney et al.
8,893,337 B2 11/2014 Lynn
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
D728,254 S 5/2015 Blazar et al.
D737,250 S 8/2015 Ingham et al.
9,314,118 B2 4/2016 Blazar et al.
9,578,941 B2 2/2017 MacLachlan et al.
9,730,524 B2 8/2017 Chen et al.
9,737,154 B2 8/2017 Mahoney et al.
D809,843 S 2/2018 Keeley et al.
D812,393 S 3/2018 Karschnik et al.
9,924,813 B1 3/2018 Basten et al.
9,936,816 B2 4/2018 Lowe
10,143,312 B2 12/2018 Brosnan et al.
D840,732 S 2/2019 Peterson et al.
10,194,753 B2 2/2019 Fleury et al.
10,285,508 B2 5/2019 Rose et al.
D857,433 S 8/2019 Kiekhoefer et al.
10,524,582 B2 1/2020 Murphy et al.
10,531,745 B2 1/2020 McGuire et al.
10,539,170 B2 1/2020 Peterson et al.
10,575,654 B2 3/2020 Shakal
10,675,835 B1 6/2020 Martin et al.
10,677,232 B2 6/2020 Shakal et al.
10,729,253 B1 8/2020 Gaunt
10,736,433 B2 8/2020 Patel et al.
10,765,224 B2 9/2020 Chen et al.
10,786,969 B1 9/2020 Strahan et al.
10,813,470 B2 10/2020 Mahoney et al.
10,888,173 B2 1/2021 Shakal et al.
10,993,546 B2 5/2021 Shakal et al.
11,001,447 B2 5/2021 Shutes et al.
11,085,479 B2 8/2021 Griffith et al.
11,096,502 B2 8/2021 Rose et al.
D932,808 S 10/2021 Keeley
11,140,999 B2 10/2021 Peterson et al.
11,160,386 B2 11/2021 Jansen et al.
11,229,297 B2 1/2022 Gaunt
11,484,128 B2 11/2022 Stusynski et al.
D982,360 S 4/2023 Negus
D1,032,243 S 6/2024 Negus et al.
2002/0069462 A1 6/2002 Gaboury et al.
2004/0097156 A1 5/2004 McGuire et al.
2004/0158928 A1 8/2004 Gladney
2005/0204475 A1 9/2005 Schmitz et al.
2005/0235417 A1 10/2005 Koughan et al.
2006/0160451 A1 7/2006 Dry et al.
2006/0236462 A1* 10/2006 Boyd ..... A47C 31/105 5/954
2007/0161312 A1 7/2007 Blanchard et al.
2008/0052830 A1 3/2008 Koughan et al.
2009/0070940 A1 3/2009 Knoff
2010/0043148 A1 2/2010 Rose et al.
2012/0036644 A1* 2/2012 Lynn ..... A47C 31/001 5/698
2013/0175057 A1 7/2013 Klancnik
2014/0250597 A1 9/2014 Chen et al.
2015/0007393 A1 1/2015 Palashewski
2015/0182418 A1 7/2015 Zaiss
2015/0290059 A1 10/2015 Brosnan et al.
2018/0125259 A1 5/2018 Peterson et al.
2018/0220807 A1 8/2018 Honig et al.
2018/0279795 A1 10/2018 Murphy et al.
2019/0082855 A1 3/2019 Brosnan et al.
2019/0328150 A1 10/2019 Nolte et al.
2020/0187667 A1 6/2020 Shakal
2020/0359805 A1 11/2020 Brosnan et al.
2020/0375369 A1 12/2020 Negus et al.
2020/0400135 A1 12/2020 Shakal et al.
2021/0145183 A1 5/2021 Negus et al.
2021/0145185 A1 5/2021 Negus et al.
2021/0177155 A1 6/2021 McGuire et al.
2021/0204712 A1 7/2021 Karschnik et al.
2021/0244196 A1 8/2021 Hilden et al.
2021/0251392 A1 8/2021 Shakal
2021/0330090 A1 10/2021 Shakal et al.
2021/0341006 A1 11/2021 Griffith et al.
2022/0192388 A1 6/2022 Smith et al.
2022/0218116 A1 7/2022 Rose et al.
2022/0273118 A1 9/2022 Peterson et al.
2022/0322840 A1 10/2022 Gaunt
2022/0369827 A1 11/2022 Rose et al.
2023/0017015 A1 1/2023 Karschnik et al.
2023/0027288 A1 1/2023 Karschnik
2023/0031563 A1 2/2023 Molina et al.
2023/0057322 A1 2/2023 Shakal
2023/0063979 A1 3/2023 Doffing et al.
2023/0128215 A1 4/2023 Karschnik et al.
2023/0148764 A1 5/2023 Negus et al.
2023/0218088 A1 7/2023 Brosnan et al.
2023/0389717 A1 12/2023 Yang et al.
2024/0011476 A1 1/2024 Shakal et al.
2024/0016301 A1 1/2024 Karschnik et al.
2024/0074592 A1 3/2024 Gaunt
2024/0115055 A1 4/2024 Doffing et al.
2024/0115058 A1 4/2024 VerBockel et al.
2024/0148157 A1 5/2024 Stusynski et al.
2024/0251961 A1 8/2024 Shakal et al.

FOREIGN PATENT DOCUMENTS

KR 200375962 Y1 * 3/2005 ..... A47C 31/105
KR 2018-0072252 6/2018
TW I879890 B * 4/2025 ..... A47C 31/105
WO WO 2009/123612 10/2009
WO WO-2021096602 A1 * 5/2021 ..... A47C 31/023

OTHER PUBLICATIONS

U.S. Appl. No. 09/471,592, Shafer, Dec. 23, 1999.
U.S. Appl. No. 14/594,843, Rose et al., Jan. 12, 2015.
U.S. Appl. No. 18/196,658, Herman et al., May 12, 2023.

(56) References Cited

OTHER PUBLICATIONS

U.S. Appl. No. 18/441,524, Shakal, Feb. 14, 2024.
U.S. Appl. No. 18/597,079, Griffith et al., Mar. 6, 2024.
U.S. Appl. No. 18/627,040, Smith et al., Apr. 4, 2024.
U.S. Appl. No. 18/763,207, Negus et al., Jul. 3, 2024.
U.S. Appl. No. 29/719,090, Negus et al., Dec. 31, 2019.
U.S. Appl. No. 29/942,156, Negus et al., May 14, 2024.
International Search Report and Written Opinion in International Appln. No. PCT/US2024/021125, mailed on Sep. 3, 2024, 17 pages.
International Preliminary Report on Patentability in International Appln. No. PCT/US2024/021125, mailed on Oct. 23, 2025, 9 pages.

* cited by examiner

FLAME RESISTANT MATTRESS COVER

CROSS-REFERENCE TO RELATED APPLICATIONS

This application claims the benefit of U.S. Provisional Application Ser. No. 63/458,653, filed Apr. 11, 2023. The disclosure of the prior application is considered part of the disclosure of this application, and is incorporated in its entirety into this application.

The present document relates to mattresses for a bed, and particularly relates to protecting a mattress from a flame.

BACKGROUND

In general, a bed is a piece of furniture used as a location to sleep or relax. Many modern beds include a soft mattress on a bed frame. The mattress may include springs, foam material, textiles, and/or an air chamber to support the weight of one or more occupants. The mattress can be constructed of materials that can burn or melt responsive to contact with a flame.

SUMMARY

Protecting mattresses and sleep systems from a flame with a fire-resistant cover is described.

Some embodiments described herein include a mattress comprising including a mattress cover. The mattress cover has a first textile, a second textile, a zipper, and a fire-resistant textile wrap. The zipper connects the first textile to the second textile. The fire-resistant textile wrap covers at least a portion of the zipper. A portion of the first textile and the zipper define a seam. The seam is inwardly separated from an outer side surface of the mattress cover by the portion of the first textile.

In some implementations, a mattress insert is positioned inside the mattress cover. In some cases, the seam is under the mattress insert.

In some implementations, the mattress insert includes an air chamber. The mattress cover further includes a slit to pass an air hose from an air pump assembly to the air chamber. In some cases, the slit is positioned in the second textile. In some cases, the second textile is positioned between the mattress cover and a foundation supporting the mattress inert. In some cases, the second textile is a non-fire resistant material. In some cases, the fire-resistant textile wrap extends from the seam, past the zipper, and beyond the slit toward a center axis of the mattress cover. In some cases, the fire-resistant textile wrap is configured to seal about the air hose positioned through the slit.

In some implementations, the mattress further includes a foundation positioned below the mattress cover, the foundation supporting the mattress insert, wherein a top surface of the foundation and the mattress cover define a fire barrier.

In some implementations, the mattress further includes a fire-resistant thread coupling the zipper to the first and second textiles.

In some implementations, the seam is spaced inward from the outer side surface of the mattress by a distance such that a progress of a flame from a space outside the mattress cover toward the zipper is resisted. In some cases, the distance is between three and nine inches.

In some implementations, the first textile is a fire-resistant material.

In some implementations, the first textile is a laminate.

In some implementations, the first textile includes an outer fabric layer; and an inner fire-resistant layer laminated to the outer fabric layer.

In some implementations, the first textile is a border.

In some implementations, the second textile is a bottom filler.

In some implementations, the second textile is a single non-woven material.

In some implementations, the zipper includes a fire-resistant material.

In some implementations, the zipper includes a tape, and the tape is a fire-resistant material.

In some implementations, the zipper includes multiple of teeth, and the teeth are a fire-resistant material.

In some implementations, the zipper comprises a pull tab, the pull tab positioned to face away from the mattress insert, and the pull tab is a fire-resistant material.

Some embodiments described herein include a mattress cover having a textile enclosure, a zipper, and a fire-resistant textile wrap. The textile enclosure has an opening sized to pass a mattress insert into the mattress cover. The opening is spaced inward from an outer side surface of the textile enclosure. The zipper seals the opening of the textile enclosure. The fire-resistant textile wrap is coupled to an inner first surface of the zipper. The fire-resistant textile wrap covers at least a portion of an inner surface of the zipper.

Some embodiments described herein include a mattress. The mattress includes a mattress cover. The mattress cover has a first textile, a second textile, a zipper, and a fire resistant textile wrap. The zipper connects the first textile to the second textile. The fire-resistant textile wrap covers at least a portion of the zipper. The mattress cover includes a single chamber configured to receive a mattress insert.

Some embodiments described herein include a mattress. The mattress has a mattress cover. The mattress cover has a first textile, a second textile, a zipper, and a fire-resistant textile wrap. The zipper connects the first textile to the second textile. The fire-resistant textile wrap covers the zipper. A first edge of the first textile, a first edge of a first zipper tape of the zipper, and a first edge of the fire-resistant textile wrap are aligned.

In some implementations, aligned includes defining a single seam.

In some implementations, a first seam is sewn connecting the first textile, the second textile and the zipper, wherein the first seam is proximate the first edge of the first textile, the first edge of the first zipper tape of the zipper, and the first edge of the fire-resistant textile wrap.

In some implementations, the single seam is inside the mattress cover.

In some implementations, a fire-resistant thread passes through the first textile, the zipper, and the fire-resistant textile wrap to couple the first textile and the fire-resistant wrap to the zipper.

In some implementations, the zipper is coupled between the first textile and the second textile.

Some embodiments described herein include a mattress having a mattress cover. The mattress cover defines a first opening and a second opening smaller than the first opening. The mattress cover includes a first textile, a second textile, a zipper, and a fire-resistant textile wrap. The zipper connects the first textile to the second textile at the first opening. The fire-resistant textile wrap covers at least a portion of the zipper and the second opening.

Some embodiments described herein include a sleep system having a mattress core and a mattress cover enclosing the mattress core. The mattress cover includes a border, a bottom filler, a zipper, and a fire-resistant textile wrap. The zipper has a first side and a second side. The first side is coupled to the border and the second side is coupled to the bottom filler. The zipper is spaced inward of a perimeter of the mattress. The fire-resistant textile wrap is coupled to an inner surface of the first side of the zipper. The fire-resistant textile wrap covers at least a portion of the zipper.

The devices, system, and techniques described herein may provide one or more of the following advantages. These devices, systems, and methods can increase a mattress user's safety. For example, the fire-resistant mattress cover can resist the progress of a flame from a space outside the fire-resistant mattress cover to a space inside the fire-resistant mattress cover. Resisting the progress of flame can increase the time and/or distance a flame needs to reach flammable components of the mattress, increasing the mattress user's safety. For example, the longer period time the flame is applied to the fire-resistant mattress cover without the mattress igniting, the amount of time other flame or heat sensors have to detect the flame (a thermal event) and alert the mattress user or transmit an alarm to first responders before the mattress ignites, increasing personnel safety. By providing a fire-resistant mattress cover, an additional and separate fire-resistant wrap may not be needed, thus potentially simplifying construction and/or improving fire protection.

The details of one or more implementations are set forth in the accompanying drawings and the description below. Other features, aspects and potential advantages will be apparent from the accompanying description and figures.

DESCRIPTION OF DRAWINGS

Like reference symbols in the various drawings indicate like elements.

DETAILED DESCRIPTION

A fire-resistant mattress cover surrounds and encloses a mattress to protect the mattress from a flame. The mattress cover has a first textile, a second textile, a zipper, and a fire-resistant textile wrap. The arrangement of the textiles, the zipper, and the fire-resistant wrap can resist the progress of the flame into the fire-resistant mattress cover, protecting the mattress from the flame. By utilizing a mattress cover that is itself fire-resistant, a separate fire-resistant wrap may not be needed inside the fire-resistant cover.

Example Airbed Hardware

Figure 1A:
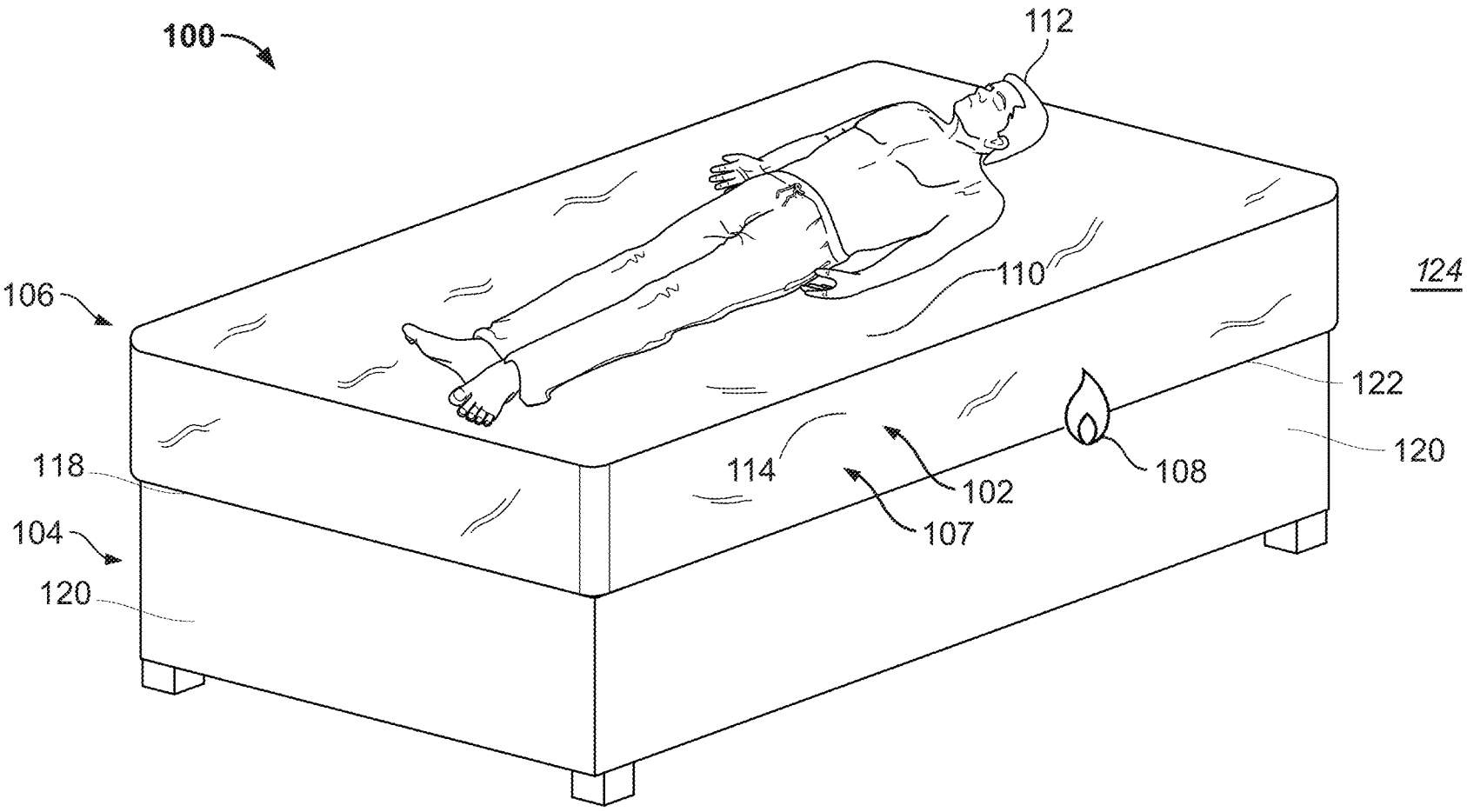
FIG. 1A shows an example sleep system with a fire-resistant mattress cover.

FIG. 1A shows an example sleep system 100 that includes a mattress 102 positioned on a foundation 104. The mattress 102 includes a fire-resistant mattress cover 106 and an internal mattress structure 107 (e.g., a mattress insert or a mattress core). The internal mattress structure 107 is enclosed by the fire-resistant mattress cover 106 to protect the mattress internal structure 107 from a flame 108.

The mattress 120 has a top surface 110 on which the mattress user 112 (user, sleeper) rests or sleeps. The mattress has a bottom surface (not shown) opposite the top surface 110. The mattress has side surfaces 114 connecting the top surface 110 to the bottom surface.

In some embodiments, the internal mattress structure 107 is constructed of foam, coil springs, air chambers, textiles, and/or other materials suitable for the application. In some embodiments, the internal mattress structure 107 can catch fire when the flame 108 is in proximity (a distance close enough for thermal transfer) to the flame 108.

In some embodiments, the internal mattress structure 107 can include at least one air chamber (details of the internal features of the mattress 102 are not shown) surrounded by a resilient border and encapsulated by the fire-resistant mattress cover 106. The resilient border can be any suitable material, such as foam. In some embodiments, the resilient border can combine with a top layer or layers of foam to form an upside down foam tub. In other embodiments, the internal mattress structure 107 can be varied as suitable for the application. In embodiments having an air chamber, the mattress 102 can include a controller and an air pump to adjust a pressure of the at least one air chamber (not shown).

The foundation 104 supports the mattress 102 above and relative to the ground. The foundation 104 has a top surface 118 positioned under and holding the mattress 102. The foundation 104 has side surfaces 120.

In some embodiments, the bed system 100 can include one or more additional components inside or near the mattress 102. For example, the bed system 100 can include a sensor system and/or a temperature control system. For example, in embodiments in which the bed system 100 includes a temperature control system, the temperature control system can be used to increase, decrease, or maintain a temperature of the mattress 102, for example for the comfort of the user. For example, a pad (e.g., mat, layer, etc.) can be placed on top of or be part of the mattress 102. Air can be pushed or drawn through the pad to heat or cool the user on the bed system 100. Additionally or alternatively, the pad can include a heating element used to keep the user warm. In some embodiments, electric equipment (controller, pump, power supplies, and circuitry) can be positioned interior to or external to the foundation 104. In some embodiments, the flame 108 can be produced external to the bed system 100. For example, the mattress user 112 can smoke a cigarette and fall asleep, dropping the cigarette on flammable paper, sheets, pillows, comforters, or blankets on the mattress 102, resulting in the flame 108. In other examples, a battery for an electronic device such as a cell phone, laptop computer, tablet, or reader can fail, causing a thermal event and resulting the paper, sheets, pillows, comforters or blankets catching fire, resulting in the flame 108. In still other examples, electric powered equipment such as a lamp can fail, causing the flame 108 near the bed system 100. The fire-resistant mattress cover 106 can be made of fire-resistant material (such as fire-resistant textiles) to resist or prevent penetration of the flame 108 into the mattress 102.

Figure 1B:
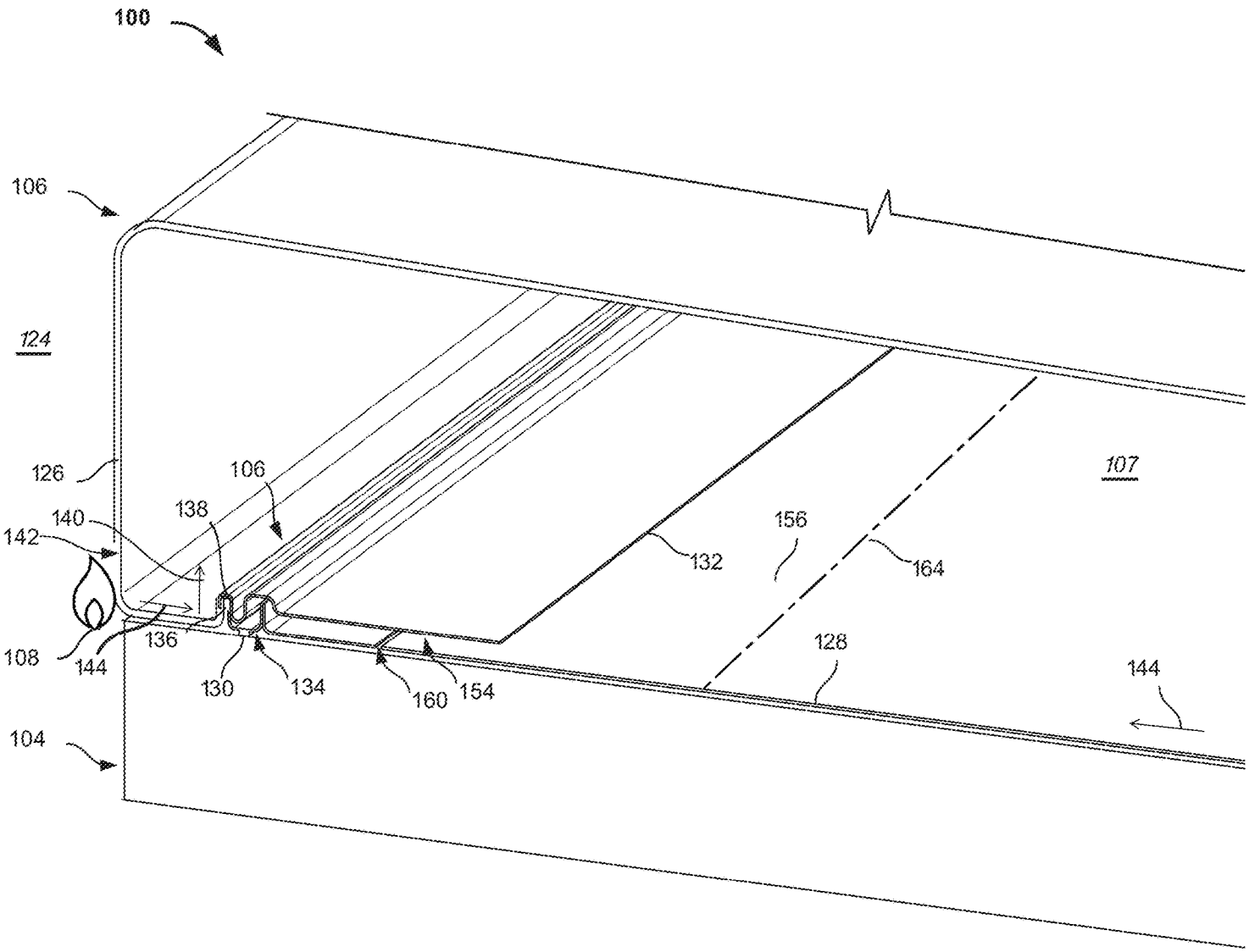
FIG. 1B is a perspective cross-section of the sleep system with the fire-resistant mattress cover of FIG. 1A.
Figure 1C:
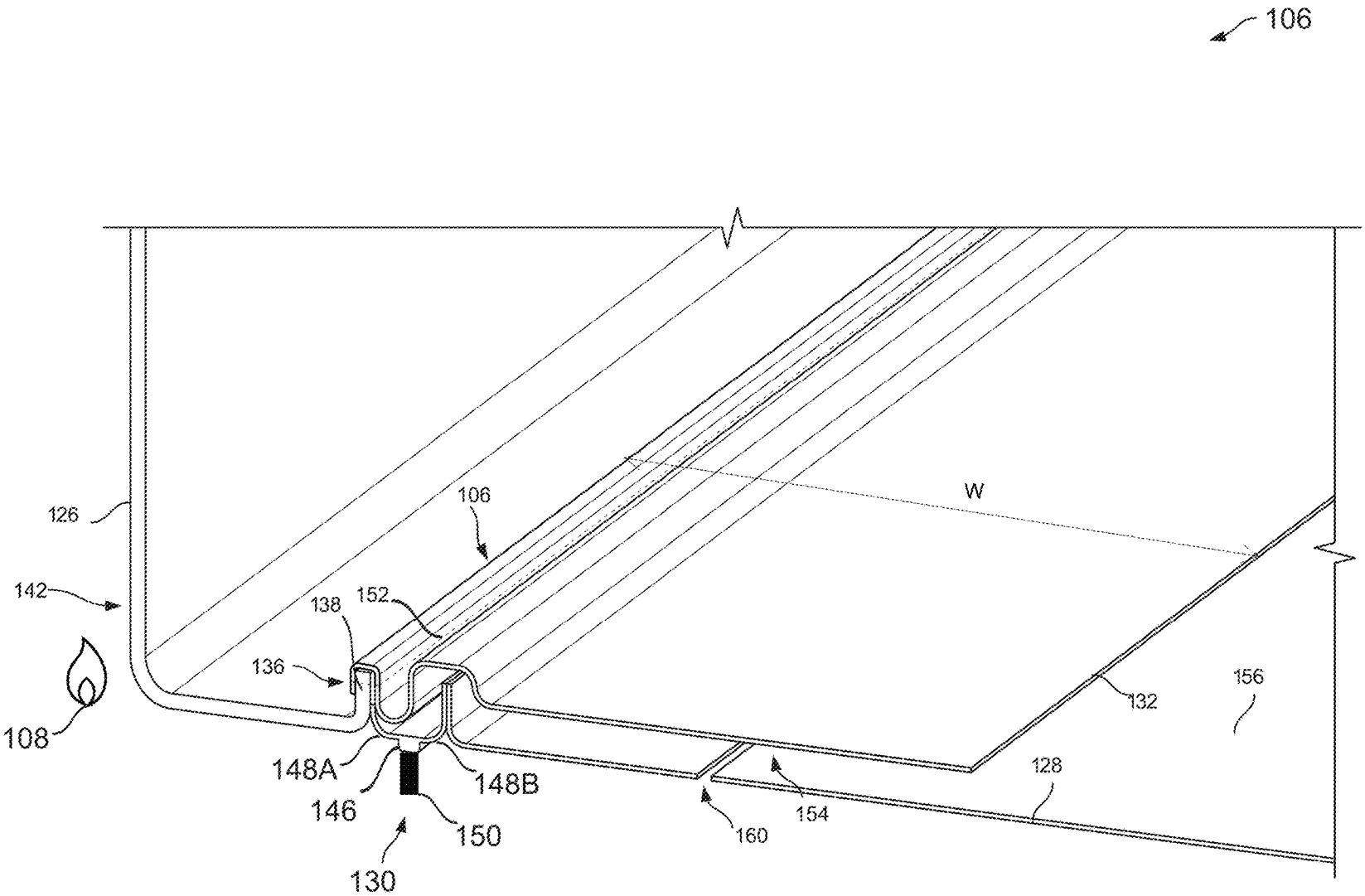
FIG. 1C is another perspective cross-section of the sleep system with the fire-resistant mattress cover of FIG. 1A.
Figure 2:
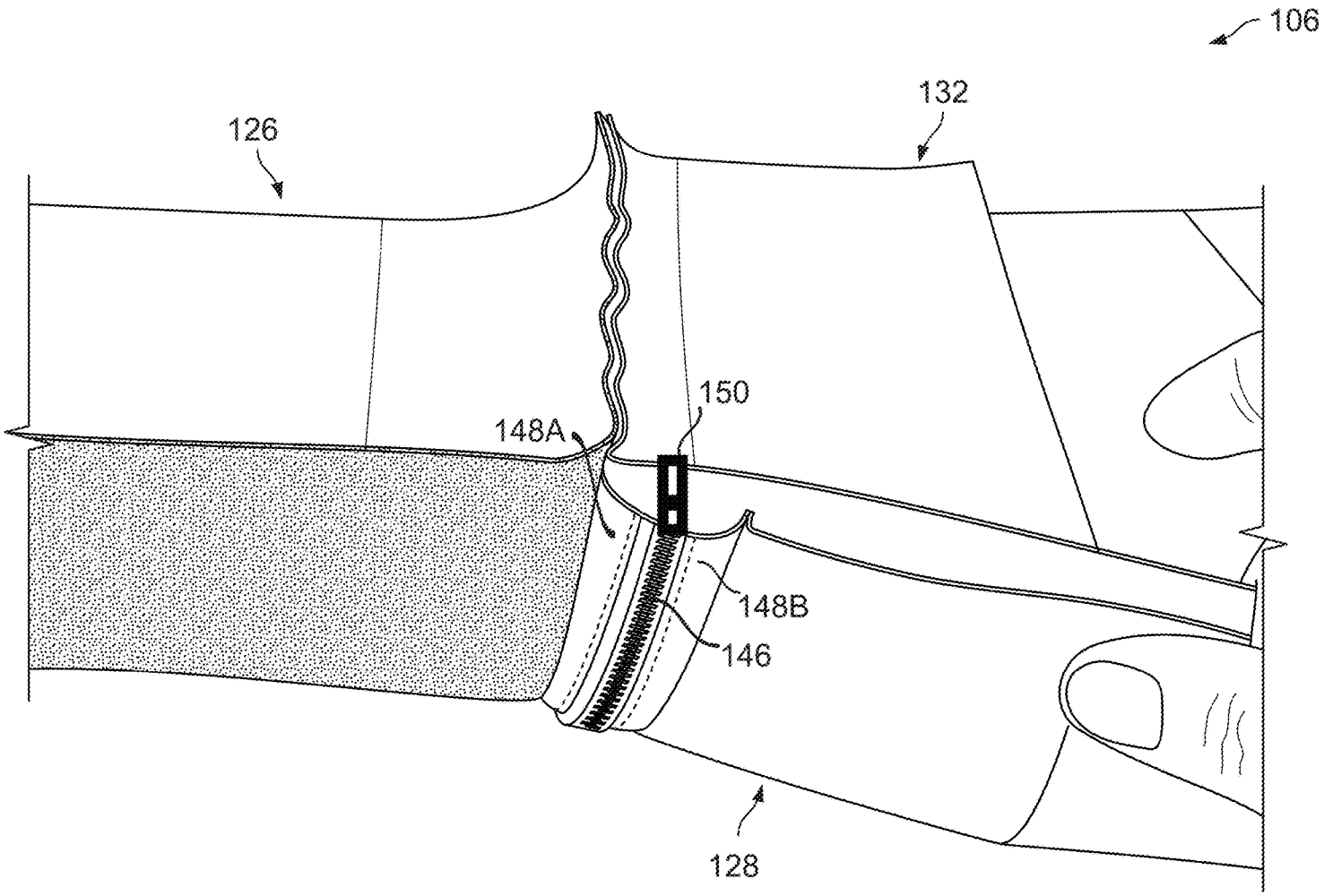
FIG. 2 is a perspective view of a portion of the fire-resistant mattress cover of FIG. 1A.
Figure 3:
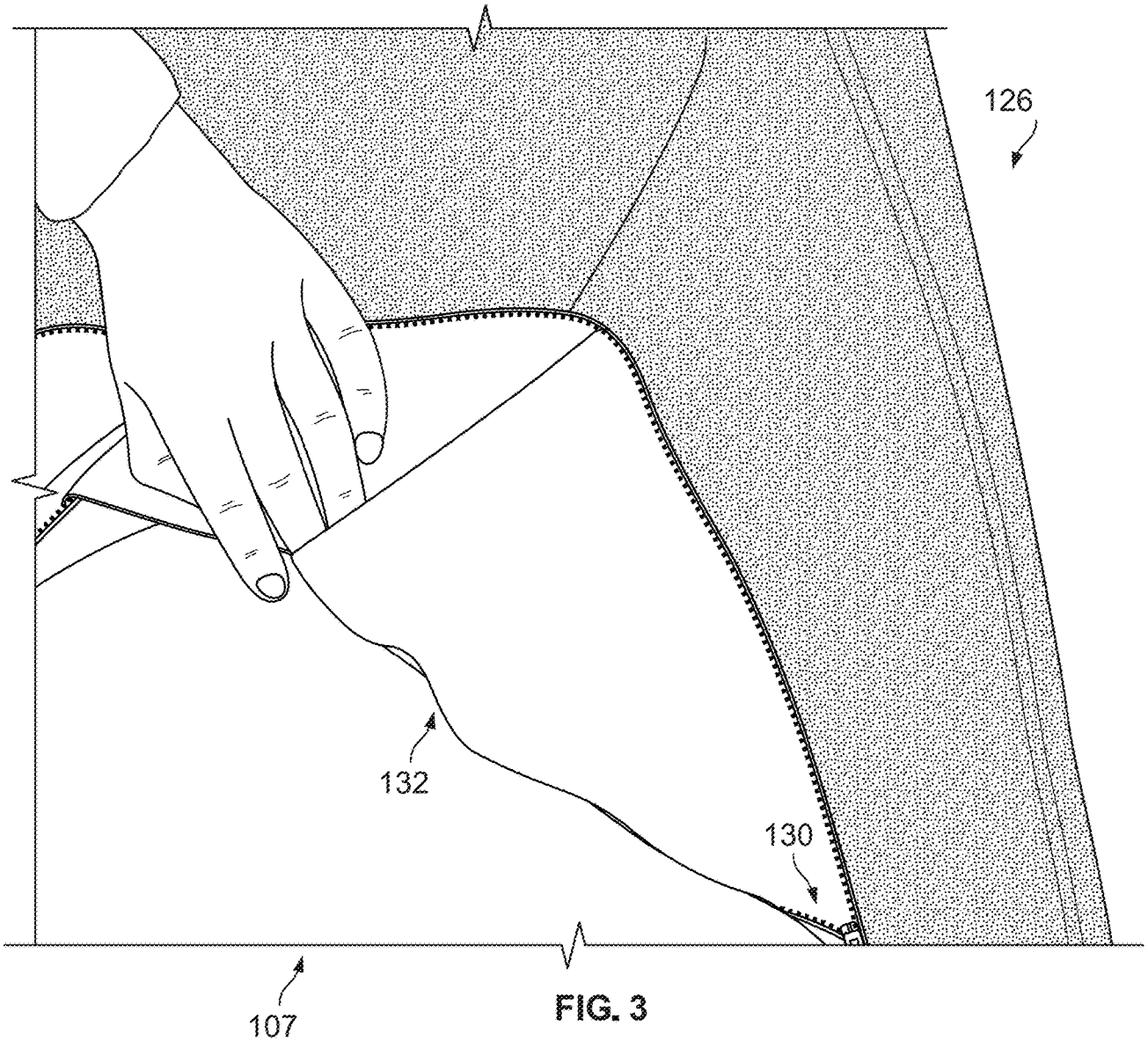
FIG. 3 is a perspective view of another portion of the fire-resistant mattress cover of FIG. 1A.
Figure 4:
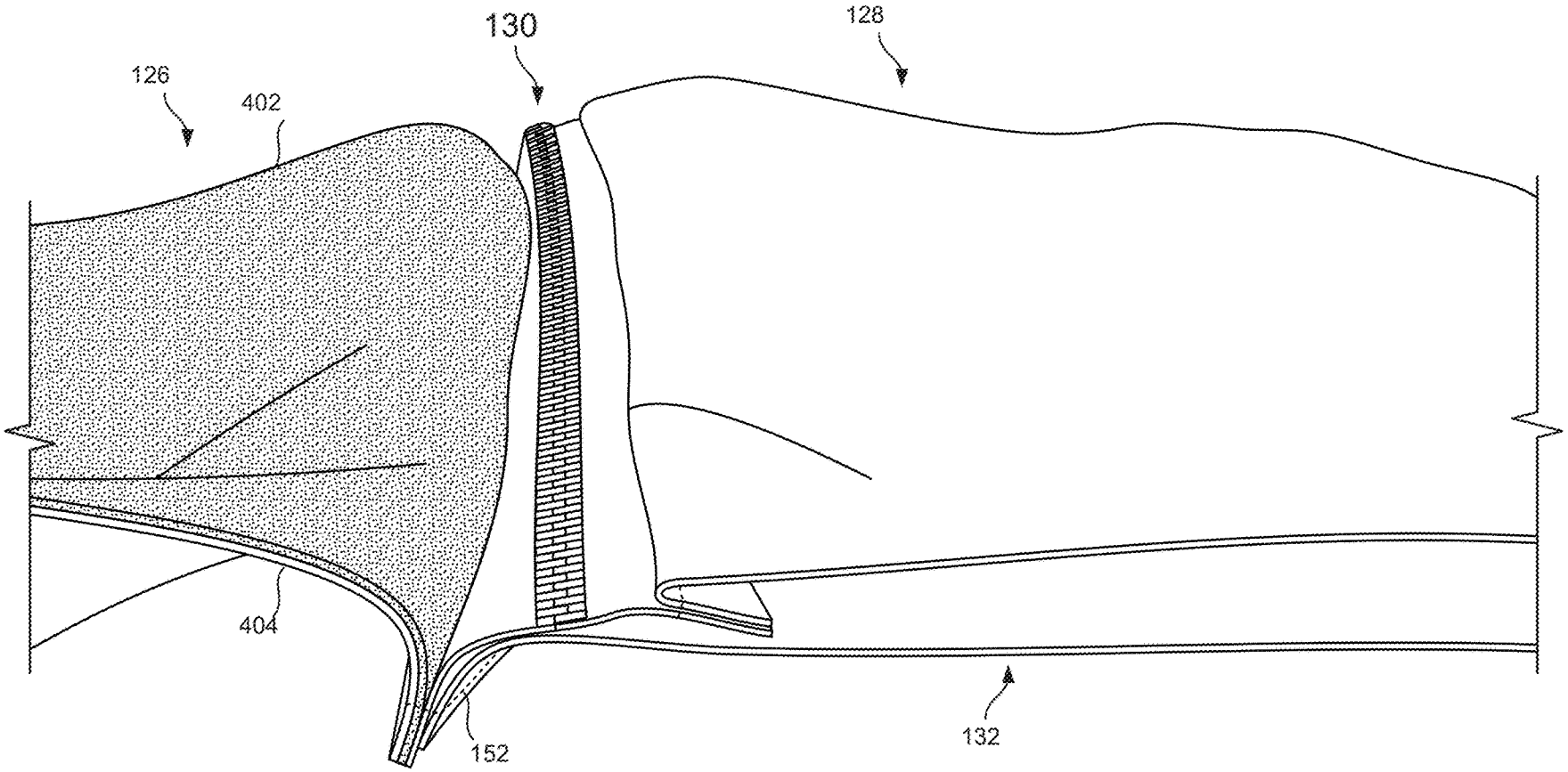
FIG. 4 is a perspective view of another portion of the fire-resistant mattress cover of FIG. 1A.

FIG. 1B is a perspective cross-section of the sleep system 100 with the fire-resistant mattress cover 106 of FIG. 1A. FIG. 1C is another perspective cross-section of the sleep system with the fire-resistant mattress cover of FIG. 1A. FIG. 2 is a perspective view of a portion of the fire-resistant mattress cover of FIG. 1A. FIG. 3 is another perspective view of another portion of the fire-resistant mattress cover of FIG. 1A. FIG. 4 is a perspective view of another portion of the fire-resistant mattress cover of FIG. 1A. Referring to FIGS. 1A-4, the flame 108 can ingress from a space 124 outside the mattress 102 to a junction 122 between the foundation 104 and the mattress 102. The fire-resistant mattress cover 106 can protect the mattress 102 from the flame 108.

Referring to FIGS. 1B-4, the fire-resistant mattress cover 106 can include a first textile 126, a second textile 128, a zipper 130, and a fire-resistant textile wrap 132. The zipper 130 connects the first textile 126 to the second textile 128. The fire-resistant textile wrap 132 covers at least a portion 134 of the zipper 130. A portion 136 of the first textile 126 and the zipper 130 define a scam 138 which is inwardly separated (in the direction of arrow 144) from an outer side surface 142 of the mattress cover 106 by the portion 136 of the first textile 126.

Referring to FIGS. 1A and 1B, the junction 122 is where the mattress 102 meets the foundation 104 to define a gap between the mattress 102 and the foundation 104. When the mattress 102 is placed on the foundation 104, the seam 138 can be spaced inward from the side surfaces 114, such that progress of the flame along the junction 122 toward the zipper 130 can be resisted or slowed. In some embodiments, the seam 138 and the zipper 130 can be spaced between three and nine inches from the side surfaces 114. Thus, the seam 138 is under the mattress 102.

Referring to FIGS. 1A-4, the first textile 126 extends across the top surface 110 of the mattress 102 and down the side surfaces 114. In some embodiments, the first textile 126 can be a single textile type. In other embodiments, the first textile 126 can be multiple textile types sewn together. As shown in FIGS. 1B and 1C, the first textile 126 extends from and around the side surfaces 114 of the mattress 102 inward (in the direction of arrows 144) along the bottom surface of the mattress 102. In some embodiments, the first textile 126 is a fire-resistant material. For example, the first textile 126 can include cotton, wool, modacrylic, an aramid, a synthetic, a natural/synthetic blend, or a fabric treated with a fire-retardant or fire-resistant chemical. In some embodiments, the first textile 126 includes a border.

In some embodiments, the first textile 126 is a laminate, (i.e., a layered composite of one or more textiles, with one, some, or all of the layers having a fire-resistant property). Referring to FIG. 4, in some embodiments, the first textile 126 has an outer layer 402 and an inner layer 404 coupled to the outer layer 402. In some embodiments, the outer layer 402 is a fabric. In some embodiments, the outer layer 402 can be referred to as a tick. In some embodiments, the inner layer 404 is an inner fire-resistant layer. In some embodiments, the inner layer 404 is laminated to the outer layer 402.

Referring to FIGS. 1A-4, in some embodiments, the second textile 128 is a bottom filler. In other embodiments, the second textile 128 is a single non-woven material. The second textile 128 can be a single textile or can be multiple textiles sewn together. The second textile 128 can form some, most, or all of a bottom of the fire-resistant mattress cover 106. The second textile 128 can be positioned adjacent a top of the foundation 104 that supports the mattress 102. In some implementations, the second textile 128 is a fire-resistant material. In some implementations, the second textile 128 is a fire-resistant material generally similar to the first textile 126. In some implementations, the second textile 128 is a fire-resistant material generally different than the first textile 126.

The fire-resistant textile wrap 132 can be an integral part of the mattress cover 106 configured to cover the zipper 130 to resist ingress of fire at the zipper 130. Referring to FIGS. 1A-4, the fire-resistant textile wrap 132 is coupled to the first textile 126 and the zipper 130 at the seam 138 and extends across the zipper 130 and a portion 154 of an inner surface 156 of the fire-resistant mattress cover 106 corresponding to the second textile 128 (in the direction of arrows 144). The fire-resistant textile wrap 132 can be formed about the seam 138 on both sides of the seam 138 as the seam 138 extends inward (in the direction of arrow 140).

The fire-resistant textile wrap 132 is a fire-resistant material. For example, the fire-resistant textile wrap 132 can include cotton, wool, modacrylic, an aramid, a synthetic, a natural/synthetic blend, or a fabric treated with a fire-retardant or fire-resistant chemical. In some embodiments, the fire-resistant textile wrap 132 is a laminate, (i.e., a layered composite of one or more textiles, with one, some, or all of the layers having a fire-resistant property).

The fire-resistant textile wrap 132 has a width W (shown in FIG. 1C). In some embodiments, the width W of the fire-resistant textile wrap 132 is between one and twelve inches.

Referring to FIG. 1C-4 (as best shown in FIG. 2), the zipper 130 has teeth 146, first and second tapes 148A and 148B, and a pull tab 150. Two rows of teeth 146 optionally engage and disengage to couple the first textile 126 to the second textile 128. The tapes 148A and 148B couple the two rows of teeth 146 to the first textile 126 and the second textile 128. The pull tab 150 couples through and extends from the teeth 146 on the first tape 148A to the teeth 146 on the second tape 146B to engage and disengage the two rows of teeth 146 responsive to a user pulling on the pull tab 150 (i.e., "zipping" the zipper 130). The pull tab 150 can be positioned to face away from the mattress 102. For example, when the mattress 102 is positioned on the foundation 104, the pull tab 150 is toward the foundation 104 or toward and contacting the foundation 104.

In some embodiments, the zipper 130 can be partially or entirely made of fire-resistant materials. For example, the teeth 146 can be a metal or a fire-resistant plastic or polymer. For example, the tapes 148A and 148B can be a fire-resistant fabric.

Referring to FIGS. 1C and 4, the fire-resistant mattress cover 106 can include a thread 152 coupling the zipper 130 to the first textile 126 and the second textile 128. In some embodiments, the thread 152 coupling the zipper 130 to the textiles 126, 128 is fire-resistant thread.

In some embodiments, the mattress cover 106 can include a slit 160 (shown in FIGS. 1B and 1C) to allow passage of an elongate structure (such as a hose, cable or wire) into the mattress. For example, the internal mattress structure 107 of the mattress 102 can include an air chamber (not shown). A pressure of the air chamber can be adjusted by an air pump that connects to the air chamber via an air hose. In such implementations, the fire-resistant mattress cover 106 has the slit 160 to pass the air hose from the air pump to the air chamber. In some implementations, the slit 160 is positioned in the second textile 128.

In embodiments having the slit 160 in the fire-resistant mattress cover 106, the fire-resistant textile wrap 132 extends from the seam 138, past the zipper 130, and beyond the slit 160 toward a center axis 164 of the fire-resistant mattress cover 106 in the direction of the arrow 144. The fire-resistant textile wrap 132 can partially or entirely cover the slit 160 to prevent or resist fire ingress through the slit 160.

Some embodiments described herein include a mattress cover having a textile enclosure, a zipper, and a fire-resistant textile wrap. The textile enclosure has an opening sized to pass a mattress insert into the mattress cover. The opening is spaced inward from an outer side surface of the textile enclosure. The zipper seals the opening of the textile enclosure. The fire-resistant textile wrap is coupled to an inner first surface of the zipper. The fire-resistant textile wrap covers at least a portion of an inner surface of the zipper.

Some embodiments described herein include a mattress. The mattress includes a mattress cover. The mattress cover has a first textile, a second textile, a zipper, and a fire resistant textile wrap. The zipper connects the first textile to the second textile. The fire-resistant textile wrap covers at least a portion of the zipper. The mattress cover includes a single chamber configured to receive a mattress insert.

Some embodiments described herein include a mattress. The mattress has a mattress cover. The mattress cover has a first textile, a second textile, a zipper, and a fire-resistant textile wrap. The zipper connects the first textile to the second textile. The fire-resistant textile wrap covers the zipper. A first edge of the first textile, a first edge of a first zipper tape of the zipper, and a first edge of the fire-resistant textile wrap are aligned.

In some implementations, aligned includes defining a single seam.

In some implementations, a first seam is sewn connecting the first textile, the second textile and the zipper, wherein the first seam is proximate the first edge of the first textile, the first edge of the first zipper tape of the zipper, and the first edge of the fire-resistant textile wrap.

In some implementations, the single seam is inside the mattress cover.

In some implementations, a fire-resistant thread passes through the first textile, the zipper, and the fire-resistant textile wrap to couple the first textile and the fire-resistant wrap to the zipper.

In some implementations, the zipper is coupled between the first textile and the fire-resistant textile wrap.

Some embodiments described herein include a mattress having a mattress cover. The mattress cover defines a first opening and a second opening smaller than the first opening. The mattress cover includes a first textile, a second textile, a zipper, and a fire-resistant textile wrap. The zipper connects the first textile to the second textile at the first opening. The fire-resistant textile wrap covers at least a portion of the zipper and the second opening.

Some embodiments described herein include a sleep system having a mattress core and a mattress cover enclosing the mattress core. The mattress cover includes a border, a bottom filler, a zipper, and a fire-resistant textile wrap. The zipper has a first side and a second side. The first side is coupled to the border and the second side is coupled to the bottom filler. The zipper is spaced inward of a perimeter of the mattress. The fire-resistant textile wrap is coupled to an inner surface of the first side of the zipper. The fire-resistant textile wrap covers at least a portion of the zipper.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

What is claimed is:

1. A mattress comprising:

a mattress cover defined by a top surface, a bottom surface and a side surface extending between the top surface and the bottom surface, the mattress cover comprising:

a first textile on the side surface and on a portion of the bottom surface;

a second textile on another portion of the bottom surface;

a zipper configured to connect the first textile to the second textile; and a fire-resistant textile wrap configured to cover at least a portion of the zipper, wherein a portion of the first textile and the zipper define a seam, the seam inwardly separated from the side surface of the mattress cover by the portion of the first textile.

2. The mattress of claim 1, further comprising a mattress insert comprising an air chamber, the mattress insert positioned inside the mattress cover, and wherein the mattress cover further comprises a slit configured to pass an air hose from an air pump assembly to the air chamber.

3. The mattress of claim 2, wherein the slit is positioned in the second textile.

4. The mattress of claim 2, wherein the second textile is positioned between the mattress cover and a foundation supporting the mattress insert.

5. The mattress of claim 2, wherein the second textile is a non-fire resistant material.

6. The mattress of claim 2, wherein the fire-resistant textile wrap extends from the seam, past the zipper, and beyond the slit toward a center axis of the mattress cover.

7. The mattress of claim 2, wherein the fire-resistant textile wrap is configured to seal about the air hose positioned through the slit.

8. The mattress of claim 2, further comprising a foundation positioned below the mattress cover, the foundation supporting the mattress insert, wherein a top surface of the foundation and the mattress cover define a fire barrier.

9. The mattress of claim 1, further comprising a fire-resistant thread coupling the zipper to the first and second textiles.

10. The mattress of claim 1, wherein the seam is spaced inward from the side surface of the mattress by a distance such that a progress of a flame from a space outside the mattress cover toward the zipper is resisted.

11. The mattress of claim 1, wherein the first textile is a fire-resistant material.

12. The mattress of claim 1, wherein the first textile is a laminate.

13. The mattress of claim 1, wherein the first textile comprises:

an outer fabric layer; and an inner fire-resistant layer laminated to the outer fabric layer.

14. The mattress of claim 1, wherein the first textile is a border.

15. The mattress of claim 1, wherein the second textile is a bottom filler.

16. The mattress of claim 1, wherein the second textile is a single non-woven material.

17. The mattress of claim 2, wherein the zipper comprises:

a tape comprising a fire-resistant material;

a plurality of teeth coupled to the tape, the plurality of teeth comprising a fire-resistant material; and a pull tab, the pull tab positioned to face away from the mattress insert, the pull tab comprising a fire-resistant material.

18. A mattress comprising:

a mattress cover comprising:

a first textile;

a second textile;

a zipper configured to connect the first textile to the second textile, the zipper coupled between the first textile and the second textile;

a fire-resistant textile wrap configured to cover an interior side of the zipper, wherein a first edge of the first textile, a first edge of a first zipper tape of the zipper, and a first edge of the fire-resistant textile wrap are aligned defining a single seam inside the mattress cover, the single seam sewn to connect the first textile, the fire-resistant textile wrap, and the zipper; and a fire-resistant thread passes through the first textile, the zipper, and the fire-resistant textile wrap to couple the first textile and the fire-resistant textile wrap to the zipper.

19. The mattress of claim 18, wherein the single seam is proximate the first edge of the first textile, the first edge of the first zipper tape of the zipper, and the first edge of the fire-resistant textile wrap.

20. A sleep system comprising:

a mattress core; and a mattress cover enclosing the mattress core, the mattress cover comprising:

a border;

a bottom filler coupled to the border, the border and the bottom filler defining a first opening, the bottom filler comprising a second opening smaller than the first opening;

a zipper having a first side and a second side, the first side coupled to the border and the second side coupled to the bottom filler, the zipper spaced inward of a perimeter of the mattress core, the zipper configured to connect the border to the bottom filler at the first opening; and a fire-resistant textile wrap coupled to an inner surface of the first side of the zipper, the fire-resistant textile wrap configured to cover at least a portion of the zipper and the second opening.

* * * * *